United States Patent [19]

Law et al.

[11] 4,253,975

[45] Mar. 3, 1981

[54] AQUEOUS LUBRICANTS CONTAINING METAL HYDROCARBYL DITHIOPHOSPHATES

[75] Inventors: Derek A. Law; Robert H. Davis, both of Pitman; Harry J. Andress, Wenonah, all of N.J.

[73] Assignee: Mobil Oil Corporation, New York, N.Y.

[21] Appl. No.: 70,280

[22] Filed: Aug. 27, 1979

[51] Int. Cl.[3] ..... C10M 1/32; C10M 1/48

[52] U.S. Cl. ..... 252/32.7 E; 252/75

[58] Field of Search ..... 252/32.7 E, 75, 79 R

[56] References Cited

U.S. PATENT DOCUMENTS

| | | | |
|---|---|---|---|
| 3,843,542 | 10/1974 | Adams et al. | 252/75 |
| 4,086,172 | 4/1978 | Lowe | 252/32.7 E |
| 4,094,800 | 6/1978 | Warne | 252/32.7 E |
| 4,101,429 | 7/1978 | Birke | 252/32.7 E |

*Primary Examiner*—W. J. Shine

*Attorney, Agent, or Firm*—Charles A. Huggett; Michael G. Gilman; Claude E. Setliff

[57] ABSTRACT

Lubricating oils, which in aqueous media are useful hydraulic fluids and the like, contain a metal hydrocarbyl dithiophosphate and a system of other additives which solubilize the dithiophosphates in the aqueous oils.

10 Claims, No Drawings

AQUEOUS LUBRICANTS CONTAINING METAL HYDROCARBYL DITHIOPHOSPHATES

BACKGROUND OF THE INVENTION

1. Field of the Invention

The invention relates to lubricating oils, and particularly to oils suitable for admixing with water to form hydraulic fluids and the like. The invention is more particularly concerned with an aqueous lubricant system containing a metal dithiophosphate and a system of solubilizers for said dithiophosphate.

2. Discussion of the Prior Art

With increasing use of hydraulic fluids and the like, there are more and more sophisticated machine systems which demand closer tolerances to perform new and more difficult functions. They therefore require better thermal and oxidative stability, and, for many hydraulic systems the fluids must have enhanced antiwear properties.

In addition to systems containing fluids made up of oil and water, oil systems per se often accidentally come into contact with water, as by leakage around seals or worn parts or through condensation.

One very effective antiwear agent for compounding with a functional fluid is a metal dihydrocarbyl dithiophosphate. These are illustrated, for example, in U.S. Pat. No. 4,101,429, which discloses a lubricating oil comprising oil and a dithiophosphate mixed with certain dimeric acids and a reaction product of alkenylsuccinic anhydride and polyalkylene polyamines. Also, U.S. Pat. No. 4,094,800 teaches a lubricating oil composition containing oil and a basic dithiophosphate mixed with a nonacidic compound comprising a reaction product of a succinic anhydride and an alcohol and an amine. No art is known that teaches the particularly compositions of this invention, however.

SUMMARY OF THE INVENTION

In accordance with the invention there is provided a product comprising a member selected from:

(1) a mixture comprising a dihydrocarbyl dithiophosphate and a hydroxyl-containing alkylamine having 2 to 100 carbon atoms or the reaction product made by reacting an alkenylsuccinic anhydride or acid wherein the alkenyl is derived from a mixture of $C_{16}$ to $C_{28}$ olefins with (A) a hydroxyl-containing alkylamine having 2 to 100 carbon atoms, or (B) a hydroxypolyetheramine of the formula

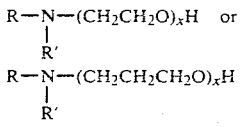

wherein R and R′ are $C_8$ to $C_{18}$ hydrocarbyl groups or R′ is a $-(CH_2CH_2O)_yH$ group and R is a $C_8$ to $C_{18}$ hydrocarbyl group, x is from about 2 to about 50;

(2) the reaction product of (B) reacted with polyethylene glycol;

(3) the mixture of (1) plus from about 0.5% to about 15% by weight of a $C_2$ to $C_{10}$ monocarboxylic acid, or (4) the mixture of (1) or (2) plus a rosin soap.

The invention also provides the stated compositions with water and the product mixed with other agents such as lubricating oils, glycols and oxidized oils and these compositions with water.

DESCRIPTION OF SPECIFIC EMBODIMENTS

The dihydrocarbyl dithiophosphate of this invention, where "dihydrocarbyl" is alkyl, are generally made from a dithiophosphoric acid having the formula:

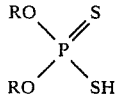

wherein R comprises an alkyl group containing about 1 to about 30 carbon atoms. The hydrocarbyl groups originate from primary alcohol, examples of which are normal alcohols such as n-heptyl, n-octyl, n-decyl, and n-dodecyl or from branched chain alcohols such as methyl- or ethyl-branched isomers of the above.

Suitable branched alcohols are 2-methyl-1-pentanol, 2-ethyl-1-hexanol, 2,2-dimethyl-1-octanol, and alcohols prepared from olefin oligomers such as propylene dimer or trimer by hydroboration-oxidation or by the Oxo process. It may be preferable to use mixtures of alcohols because of their low cost and possible improvements in performance.

The dialkyl dithiophosphoric acids are generally made by reaction of about 4 moles of alcohol with one mole of a phosphorus pentasulfide containing about 27 weight percent phosphorus. The phosphorus pentasulfide should have approximately the following properties:

Melting point, ° F.: 270–280
Wt. percent phosphorus: 25–30
Wt. percent sulfur: 70–75
Free of organic material.

The reaction vessel is fitted with suitable agitation equipment. The reaction is conducted at a temperature from about 100° F. to about 250° F. for a period in the range of about 1–6 hours. The alcohol is preferably free of water.

These dihydrocarbyl dithiophosphoric acids may then be reacted with an unsaturated hydrocarbyl group, an amine, ammonia or an ammonium compound to form an ashless dithiophosphoric acid or with, for example, a metal oxide or hydroxide at from about 75° C. to about 150° C. The reaction is usually complete within from about 1 hour to about 4 hours using a temperature within the stated range and sufficient reactant compound to react with all the acid hydrogens present.

Of the metals zinc is preferred, but others, especially from Groups I and II, may be used.

Included among the hydroxyalkylamine are trialkanolamine where the alkane portion has from 2 to 100 carbon atoms. For example, these specifically include triethanolamine, triisopropanolamine, and the like. The preferred member is triethanolamine.

The monocarboxylic acids useful in the practice of this invention include acetic, propionic, butyric, pentanoic, octanoic and decanoic acids.

One of the required components is the reaction product of alkenylsuccinic anhydride or acid and an amine. The alkenylsuccinic anhydride used is made by reacting maleic anhydride in accordance with prior art procedures with a mixture of $C_{18}$–$C_{28}$ olefins. The preferred olefin mixture is the bottoms from an olefin oligomerization, the mixture having a composition as follows:

TABLE 1

| Ingredient | % by wt. | Other |
|---|---|---|
| Olefin (chain length) | | |
| $C_{16}$ | 2 max. | |
| $C_{18}$ | 5–15 | |
| $C_{20}$ | 42–50 | |
| $C_{22}$ | 20–28 | |
| $C_{24}$ | 6–12 | |
| $C_{26}$ | 1–3 | |
| $C_{28}$ | 2 max. | |
| Alcohol | 10 max. | |
| Paraffin | 5 max. | |
| Iodidine NO. | | 74 min. |
| Peroxide | | 10 ppm max. |
| Olefin types by NME | | |
| Vinyl | 28–44 | |
| Branched | 30–50 | |
| Internal | 26–42 | |

Because of the source of the olefin mixture, one does not always get the same product from successive batches, but each mixture used will have a composition falling within the ranges stated and will be equally effective for use in this invention. The olefin mixture is reacted with maleic anhydride or acid to give the polyolefin-substituted succinic compound at from about 150° C. to about 250° C. The amount of olefin should be at least stoichiometrically equivalent to the maleic anhydride reactant. It may be advantagous to use an excess of olefin to assure complete reaction. The art will understand the amount of excess necessary, if any.

The reaction of the acid or anhydride with the hydroxyamine compounds (which term includes both the hydroxy alkylamines and the hydroxypolyetheramine types) can be carried out at from about 100° C. to about 300° C., preferably 150° C. to 250° C. and for a time sufficient to form the product, usually about 3 hours to about 6 hours. The time and temperature of reaction are not critical and will obviously depend in some measure upon the reactants selected.

The relative amounts of anhydride or acid and hydroxyamine will depend upon the degree of reaction desired. The preferred reaction mixture will have at least two moles of hydroxyamine and the reaction at the end of the reaction time will have substantially no anhydride bonds and substantially no acid.

It is not known what the structure of the anhydride or acid-hydroxyamine product is. The types of products possible include amides, imides, ester/amides, ester/-salts, etc., depending upon the conditions employed and upon whether the acid or anhydride is used.

In the reaction involving the succinic compound, hydroxypolyetheramine and polyethylene glycol, the same amounts of the former two reactants as mentioned hereinabove, should be used. Preferably, an amount from about one-quarter to about one-half of the anhydride or acid will be used. The temperatures and times will be about the same as those stated for the anhydride or acid-hydroxypolyetheramine reaction.

The addition of the rosin soap or monocarboxylic acid is done at room temperature or at moderately elevated temperatures, e.g. at from about 25° C. to about 50° C. "Rosin soap" is a metal salt, preferably an alkali metal salt of rosin acid where the acid is mostly abietic acid.

When oils or glycols are mixed with one of the products of the Summary, such products will be present in the solution to the extent of from about 1% to about 90% of the solution.

The amount of alkenylsuccinic anhydride-amine reaction product, as defined in (A) and (B) of the Summary, rosin soap and metal dihydrocarbyl dithiophosphate in the neat composition will fall within the following ranges. The anhydride-amine product will range from about 1% to about 90%, preferably from about 10% to about 80%, the dithiophosphate from about 1% to about 30%, preferably from about 5% to about 20% and the rosin soap from about 1.0% to about 20%, preferably from about 1.0% to about 10%, all by weight of the composition.

The lubricating oils which may be used with the compositions of the invention include both petroleum products and synthetic fluids of lubricating viscosity. Of the latter class may be included synthetic ester lubricants, such as those formed from monohydric alcohols and dicarboxylic acids, glycols or glycerols with monocarboxylic acids, and penta erythritols with carboxylic acids, including alcohols having from about four to about 20 carbons, and carboxylic acids having from two to about 18 carbon atoms. Many synthetic esters may have mixed alcohols or carboxylic acids. Commonly may be included 2-ethylhexyl sebacate, trimethylolpropane trioctanoate, and especially pentaerythritol esters of valeric acid, isovaleric acid, caproic acid, caprylic acid, pelargonic acid, capric acid, and the like. Of special interest is a mixed pentaerythritol ester of an equimolar proportion of commercial valeric acid (containing isovaleric acid) and pelargonic acid. Other synthetic fluids include liquid polyolefins, alkylene oxide fluids, silicone fluids, polyacetals, and simple hydrocarbons of stable fluid viscosities.

Others that may be used include oxidized oils, either synthetic or mineral. These may have been oxidized by flowing the oil with air, or with air in the presence of lime. Furthermore, they may have been further reacted with, for example, $P_2S_5$ as disclosed in U.S. Pat. No. 4,028,259.

The Examples shown in Table 2 illustrate the invention in a more specific way. It should be understood that they are only illustrative and are not intended to unnecessarily limit the scope of the invention.

The product used to illustrate the invention was made by mixing 600 parts (1.2 moles) of $C_{18}$–$C_{28}$ alkenylsuccinic anhydride (made using the olefin mixture detailed hereinabove), 1200 parts (2.4 moles) of a polyoxyethylene soyamine made by hydrolyzing soybean oil, converting it to the acid, forming the $C_{16}$–$C_{18}$ primary amine and reacting it with 5 moles of ethylene oxide and 180 parts (0.3 mole) of polyethylene glycol having a molecular weight of 600 and stirring the mixture to about 260° C. over a 5 to 6 hour period. The final product was a mixture of compounds.

EVALUATION

The product of the Example was compounded with various ingredients and tested in the Vickers 104C Pump Test. The test procedure given in ASTM 28–82 was used, with the following modifications:

Pump pressure—800 psi
Pump ring—8 gal./min.
RPM—1200
Filter—10 micron
Operating Temp.—120° F.

The compositions and the results from testing them in the Vickers test are summarized in Table 2.

TABLE 2

| Example No. | Lubricant Concentrate, % Wt. Anhydride Amine-Polyglycol Product | Rosin Soap | Zn Dibutyl-Dithiophosphate (Butanol) | Ashless (B) Dithiophosphate | Triethanolamine | Caprylic Acid | Water | Commercial[3] Cutting Oil | Wear, mg/hr. Test Duration Hours | 5% Lube Concentrate 95% Water | Comments |
|---|---|---|---|---|---|---|---|---|---|---|---|
| 1 | — | — | 100 | — | — | — | — | — | Can't run - insoluble in water | | |
| 2 | — | — | — | 100 | — | — | — | — | " | | |
| 3 | — | — | — | 10 | 30 | 15 | 45 | — | " | | |
| 4 | — | — | 10 | — | 30 | 15 | 45 | — | " | | |
| 5 | — | — | — | — | — | — | — | 100 | 300 | 31 | |
| 6 | — | — | 20 | — | — | — | — | 80 | 94 | 39 | Test discontinued due to high wear rate. |
| 7 | 95 | 5 | — | — | — | — | — | — | 114 | 38 | Test discontinued due to high wear rate. |
| 8 | 76 | 4 | 20 | — | — | — | — | — | 300 | 13 | |
| 9 | 76 | 4 | — | 20 | — | — | — | — | 300 | 5 | |

[1]Dresinate 91 - Potassium rosin soap manufactured by Hercules Powder Co.
[2]Vinylbutylether adduct of isobutyldithiophosphoric acid.
[3]A chlorinated soluble cutting fluid containing sodium sulfonate emulsifier.

Examples 1-4 in Table 2 show that conventional zinc and ashless dithiophosphate are water insoluble and therefore unsatisfactory for water base hydraulic fluids. Combination with amine soap, i.e. triethanolamine caprylate, also results in an unstable product. Examples 5 and 6 show that the performance of a conventional soluble cutting fluid containing a sodium sulfonate base, which gives marginal results alone, is rendered unsatisfactory by the addition of a zinc dithiophosphate. Examples 8-9 illustrate that dithiophosphates are highly effective as antiwear agents when combined with an amine/ester and a rosin soap.

We claim:

1. A product comprising (1) a mixture comprising a dihydrocarbyl dithiophosphate and a hydroxyl-containing alkylamine having 2 to 100 carbon atoms or the reaction product made by reacting an alkenylsuccinic anhydride or acid wherein the alkenyl is derived from a mixture of $C_{16}$ to $C_{28}$ olefins with (A) a hydroxyl-containing tertiary amine having 2 to 100 carbon atoms, or (B) a hydroxypolyetheramine of the formula $$R-\underset{\underset{R'}{|}}{N}-(CH_2CH_2O)_xH \quad \text{or}$$

$$R-\underset{\underset{R'}{|}}{N}-(CH_2CH_2CH_2O)_xH$$

wherein R and R' are $C_8$ to $C_{18}$ hydrocarbyl groups or R' is a $-(CH_2CH_2O)_yH$ group and R is a $C_8$ to $C_{18}$ hydrocarbyl group, x is from about 2 to about 50;

(2) the reaction product of (B) reacted with polyethylene glycol;

(3) the mixture of (1) plus from about 0.5% to about 15% by weight of a $C_2$ to $C_{10}$ monocarboxylic acid, or (4) the mixture of (1) or (2) plus a rosin soap.

2. The composition of claim 1 wherein the alkylamine is triethanolamine.

3. The composition of claim 1 wherein the hydroxypolyetheramine is a $C_{16}$ to $C_{18}$ primary amine reacted with 5 moles of ethylene oxide.

4. The composition of claim 1 wherein the polyethylene glycol has a molecular weight of 600.

5. The composition of claim 1 wherein the rosin soap is the potassium salt of rosin acid.

6. The composition of claim 4 wherein the rosin acid is predominantly abietic acid.

7. The composition of claim 1 wherein the mixture of olefins fall within Table 1 of the specification.

8. The composition of claim 1 wherein the monocarboxylic acid is caprylic acid.

9. The composition of claim 1 wherein the dihydrocarbyl dithiophosphate is zinc dibutyl dithiophosphate.

10. The composition of claim 3 wherein the hydroxypolyetheramine is a polyoxyethylene soyamine.

* * * * *